US006772817B2

(12) United States Patent
Lai et al.

(10) Patent No.: US 6,772,817 B2
(45) Date of Patent: Aug. 10, 2004

(54) ADJUSTABLE WINDOW BLIND CORD STOPPER

(75) Inventors: John Lai, Rowland Heights, CA (US); Eric Lai, Rowland Heights, CA (US)

(73) Assignee: Tony Lai, Rowland Heights, CA (US)

( * ) Notice: Subject to any disclaimer, the term of this patent is extended or adjusted under 35 U.S.C. 154(b) by 0 days.

(21) Appl. No.: 10/104,552

(22) Filed: Mar. 22, 2002

(65) Prior Publication Data

US 2002/0096267 A1 Jul. 25, 2002

Related U.S. Application Data

(62) Division of application No. 09/733,715, filed on Dec. 11, 2000, now Pat. No. 6,453,974.

(51) Int. Cl.[7] ..... E06B 9/324
(52) U.S. Cl. ..... 160/178.2
(58) Field of Search ..... 160/168.1 R, 173 R, 160/178.2 R, 177 R, 178.3 R, 178.1 R, 115, 176.1 R; 24/570, 30.5, 30.5 P, 129 R, 129 A, 129 D, 713.1, 429

(56) References Cited

U.S. PATENT DOCUMENTS 2,164,206 A * 6/1939 Gits et al.
2,335,892 A * 12/1943 Wood
4,967,824 A * 11/1990 Colson et al.
5,542,461 A * 8/1996 Huang
6,453,974 B1 * 9/2002 Lai et al.
6,571,854 B1 * 6/2003 Palmer

* cited by examiner

*Primary Examiner*—Blair M. Johnson
(74) *Attorney, Agent, or Firm*—Raymond Y. Chan; David and Raymond Patent Group

(57) ABSTRACT

An adjustable window blind cord stopper includes a locking guider slidably connected on a lift cord of the window blind assembly by constructing an adjustable knot at a guiding through slot of the locking guider. In which, in an unlocked position that the adjustable knot is normally loosen with respect to the locking guider, the cord stopper is adapted for sliding along the cord in such a manner that when the adjustable knot is positioned above the guiding through slot, the cord stopper is adapted to slide downwardly along the lift cord, and when the adjustable knot is positioned below the guiding through slot, the cord stopper is adapted to slide upwardly along the lift cord. Thereby, the folding or unfolding condition of the slats of the window blind assembly can be locked up by sliding the cord stopper between an upper position and a lower position.

5 Claims, 10 Drawing Sheets

ADJUSTABLE WINDOW BLIND CORD STOPPER

CROSS REFERENCE OF RELATED APPLICATION

This application is a divisional application and claims domestic priority under 35 U.S.C. §120 of a non-provisional application, U.S. Pat. No. 6,453,974, application Ser. No. 09/733,715, filed Dec. 11, 2000.

BACKGROUND OF THE PRESENT INVENTION

1. Field of Invention

The present invention relates to a window blind assembly, and more particularly to an adjustable window blind cord stopper, wherein the cord stopper is selectively locked on the cord, so as to lock the slats of the window blind assembly in position, which can prevent the slats from being released accidentally.

2. Description of Related Arts

Blinds and the like such as drapes and portieres are commonly used for sheltering window, separating spaces, and etc since they are easy to open and close and aesthetically appealing. Most of the blinds each comprises a traverse supporter, which is affixed to a top beam of a window and comprises a slider track mounted on a bottom of the traverse supporter, a folding device having a pair of cords slidably mounted in the slider track, and a plurality of slats horizontally and suspendedly mounted upon the folding device in such a manner that, by operating a lift lock system, the slats are slid in such a vertical manner, or individually rotated at the same time.

In order to fold up the blind, the cords are pulled downwardly, which will increase the length of the cords, in such a manner that the slats are driven to slide upwardly towards to the traverse supporter, wherein the slats are capably of locking up at a predetermined length by a frictional force between the cords and the lift lock system. Likewise, to unfold the blind, the slats are slid downwardly due to the gravity, which will shorten the length of the cords when the frictional force is released.

However, the conventional window blind assembly has a major drawback. The slats may accidentally slide down while the cords are pulled unintentionally, especially when a child plays with the blind, the bottom bar of the window blind assembly may accidentally drop down, which will causes unwanted injury to the soft and weak child.

Due to the safety purpose, the blind must incorporate with a safety device that can stop the slats from being dropped down accidentally. The most common safety device used is a hollow stopper wherein each cord is penetrated though the stopper and tie a knot thereon. So, the stopper is tied on the cord tightly in a predetermined position such that the slide-down motion of the slats is blocked by the stopper while the stopper is moved upwardly to bias against the lift lock system.

Even though the stopper can effectively lock up the blind in position, it is a hassle for a user to loose the knot on the stopper and re-tie the knot during the folding operation. In other words, whenever the user wants to fold or unfold the blind, the user must loose the knot first and slide the stopper upwardly along the cord. Then, the user must tie the knot on the stopper at the predetermined position of the cord to re-lock the blind. Some users may have difficulty to loose the knot such that the blind cannot be folded or unfolded. Due to complicated operation of the safety device, most users trend to refuse to use the safety device and detach the stopper from the blind, or simple abandon to use the blind as well.

SUMMARY OF THE PRESENT INVENTION

A main object of the present invention is to provide an adjustable window blind cord stopper, which can lock the slats of the window blind assembly in position, so as to prevent the slats from being slid down accidentally.

Another object of the present invention is to provide an adjustable window blind cord stopper, which is facilitated for a user to selectively adjust the position of the cord stopper along the cord, wherein a user does not have to loose the knot and re-tie on the stopper during folding operation.

Another object of the present invention is to provide an adjustable window blind cord stopper, the locking operation is easy and simple that every individual can operate the cord stopper without any complicated pre-step of the operation.

Another object of the present invention is to provide an adjustable window blind cord stopper, wherein the cord stopper is capably of incorporating with any conventional window blind assembly having a cord.

Another object of the present invention is to provide an adjustable window blind cord stopper, which does not require to alter the original structural design of the window blind assembly, so as to minimize the manufacturing cost of incorporating the cord stopper with every conventional window blind assembly having a cord.

Another object of the present invention is to provide an adjustable window blind cord stopper, wherein the cord stopper will not destroy the aesthetic appearance of the window blind assembly.

Accordingly, in order to accomplish the above objects, the present invention provides a blind assembly equipped with at least an adjustable cord stoppers. The window blind assembly comprises a top traverse supporter, a bottom bar, a plurality of slats, a blind supporting system for suspendedly and spacedly supporting the plurality of slats horizontally between the traverse supporter and the bottom bar, and a lifting operation system for selectively lifting up the bottom bar towards the traverse supporter and unlifting the bottom bar to drop downwardly away from the traverse supporter, wherein the lifting operation system comprises a lift lock rotatably mounted on the traverse supporter and a pair of lift cords each having a first end portion affixed to the bottom bar, wherein the two lift cords parallelly and upwardly extend to penetrate through the slats and then traversely extend through traverse supporter while a second end portion of each of the lift cords is extended out of the traverse supporter via the lift lock to control the folding and unfolding of the window blind assembly.

The cord stoppers comprises a locking guider having at least a guiding through slot provided thereon, wherein the locking guider is slidably connected to the respective lift cord of the window blind assembly by tying an adjustable knot, at the guiding through slot, with the locking guider of the cord stopper. The adjustable knot is constructed to be capable of passing through the respective guiding through slot in order to move the adjustable knot between an upper position and a lower position with respect to the locking guider of the respective stop stopper.

DETAILED DESCRIPTION OF THE PREFERRED EMBODIMENT

Referring to FIGS. 1 to 6 of the drawings, a window blind assembly 1 equipped with a pair of adjustable cord stoppers 20 according to a preferred embodiment of the present invention is illustrated.

Figure 1:
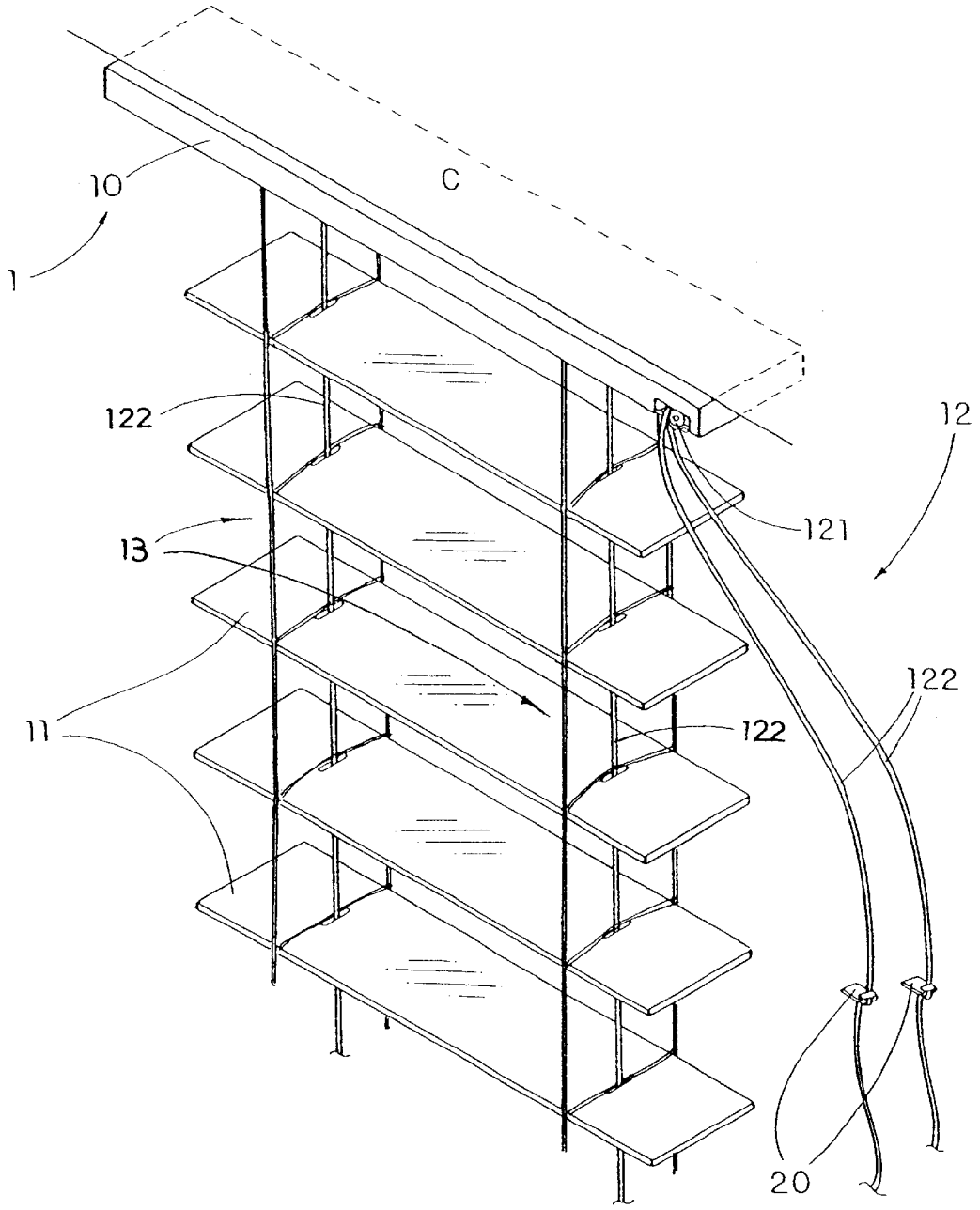
FIG. 1 is a perspective view of an adjustable cord stopper for blind arrangement according to a preferred embodiment of the present invention.

The window blind assembly 1, as shown in FIG. 1, similar to a conventional window blind assembly, comprises a top traverse supporter 10 adapted for affixing to or above a top beam C of a window, a bottom bar 101, a plurality of slats 11, a blind supporting system 13 for suspendedly and spacedly supporting the plurality of slats 11 horizontally between the traverse supporter 10 and the bottom bar 101 and controlling a tilt angle of each of the slats 11, and a lifting operation system 12 for selectively lifting up the bottom bar 101 towards the traverse supporter 10 and unlifting the bottom bar 101 to drop downwardly away from the traverse supporter 10.

The lifting operation system 12 comprises a lift lock 121 rotatably mounted on the traverse supporter 10 and a pair of lift cords 122 each having a first end portion affixed to the bottom bar 101. Each of the two lift cords 122 upwardly extends to penetrate through the slats 11 and then traversely extends through traverse supporter 10, wherein a second end portion of each of the lift cords 122 is extended out of the traverse supporter 10 via the lift lock 121 to control the folding and unfolding of the window blind assembly 1.

In order to fold up the window blind assembly 1, the lift cords 122 are pulled downwardly so as to increase the length thereof and lift up the bottom bar 101. Thus, the slats 11 are gathered upwardly by the lifting bottom bar 101 to overlap each other. Then, by pulling the second end portion of the two lift cords 122 aside can operate the lift lock 121 to lock up the uplifting position of the bottom bar 101 so as to keep the slats 11 in their folding up condition.

To unfold the window blind assembly 1, unlock the lift lock 121 by pulling the lift cords 122 to another side direction and then the bottom bar 101 and the slats 11 will slide downwardly due to the gravity. As mentioned in the background of the present invention, the main dangerous problem of the conventional window blind assembly is that if a child accidentally unlock the lift lock 121 while playing the lift cords 122, the bottom bar 101 will suddenly drop down and hit on the child that may cause serious injury.

According to the preferred embodiment of the present invention, by employing the pair of adjustable cord stoppers 20, the window blind assembly 1 can be effectively and efficiently locked from being unfold unintentionally so as to prevent the bottom bar 101 and the slats 11 from sliding downward accidentally.

Figure 2:
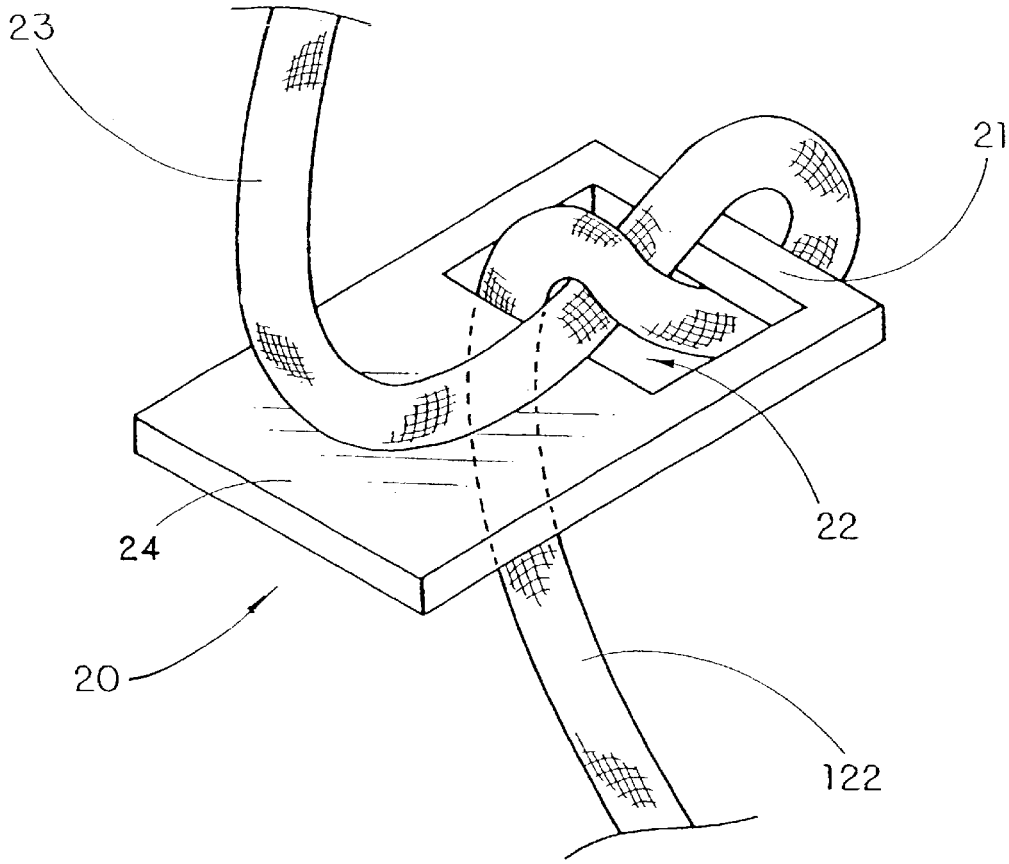
FIG. 2 is a partially perspective of the adjustable cord stopper according to the above preferred embodiment of the present invention.

As shown in FIG. 2, each of the cord stoppers 20 comprises a locking guider 21 having at least a guiding through slot 22 provided thereon, wherein the locking guider 21 is slidably connected to each lift cord 122 of the window blind assembly 1 by constructing an adjustable knot 23 at the guiding through slot 22. In order to enable the cord stopper 20 to function properly, the guiding through slot 22 cannot make as any size but should be made within a specific limited size with respect to the diameter of the lift cord 122. Preferably, a width of the guiding through slot 22 or a diameter of the guiding through slot 22 (if the guiding through slot 22 is in round shape) should be made between the sum diameter of two lift cords 122 and the sum diameter of three lift cords 122. For example, if the diameter of a lift cord 122 is 2 mm, the preferred size of the guiding through hole 22 is between 4 mm to 6 mm.

Referring to FIGS. 6A through 6C, the adjustable knot 23 is constructed by tying the lift cord 122 on the locking guider 21 of the cord stopper 20 through the following steps:

a) Forming a loop on the lift cord 122, as shown in FIG. 6A;

b) Passing the loop of the lift cord 122 through the guiding through slot 22 of the cord stopper 20, as shown in FIG. 6B;

c) Penetrating the second end portion of the lift cord 122 into the loop of the lift cord 122 so as to form the adjustable knot 23 tying around the locking guider 21, as shown in FIG. 6C.

It is worth to mention that the adjustable knot 23 is constructed to be capable of passing through the guiding through slot 22 in order to move the adjustable knot 23 between the upper position and the lower position with respect to the locking guider 21. In other words, the guiding through slot 22 has a width slightly larger than a size of the adjustable knot 23 in such a manner that the adjustable knot 23 is driven to be loosen automatically while the adjustable knot 23 passes through the guiding through slot 22.

Figure 4:
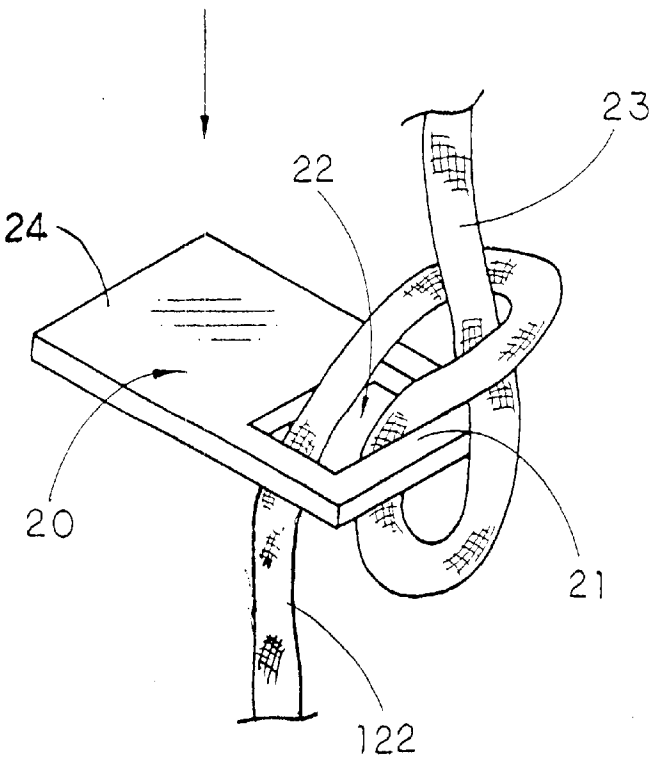
FIG. 4 is a perspective view of the adjustable cord stopper according to the above preferred embodiment of the present invention, illustrating the position of the adjustable knot while the cord stopper is sliding downward.
Figure 3:
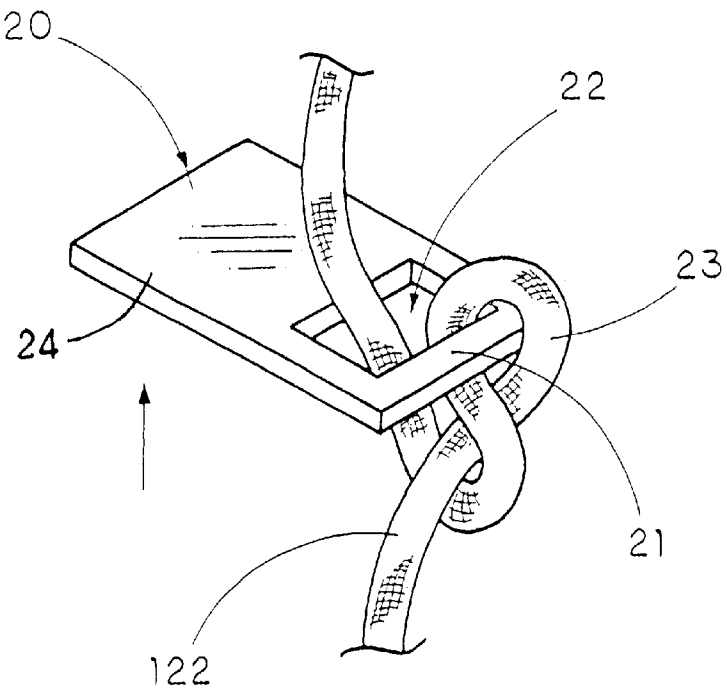
FIG. 3 is a perspective view of the adjustable cord stopper according to the above preferred embodiment of the present invention, illustrating the position of the adjustable knot while the cord stopper is sliding upward.

In an unlocked position, the adjustable knot 23 is normally loosen with respect to the locking guider 21 in such a manner that the cord stopper 20 is adapted for sliding along the lift cord 122. Accordingly, when the adjustable knot 23 is moved in an upper position that above the guiding through slot 22, the cord stopper 20 is adapted for sliding downwardly along the lift cord 122, as shown in FIG. 4. When the adjustable knot 23 is moved in a lower position that below the guiding through slot 22, the cord stopper 20 is adapted for sliding upwardly along the lift cord 122, as shown in FIG. 3.

Figure 5:
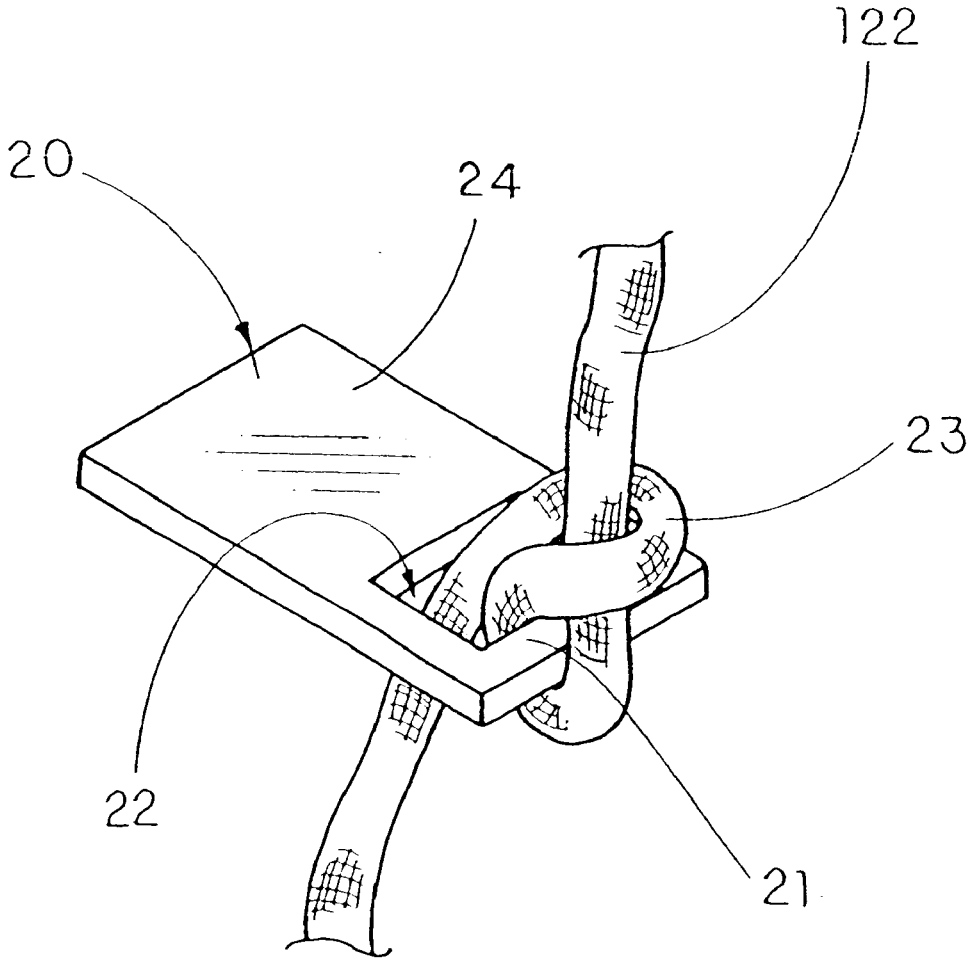
FIG. 5 is a perspective view of the adjustable cord stopper in a locked position according to the above preferred embodiment of the present invention.
Figure 6:
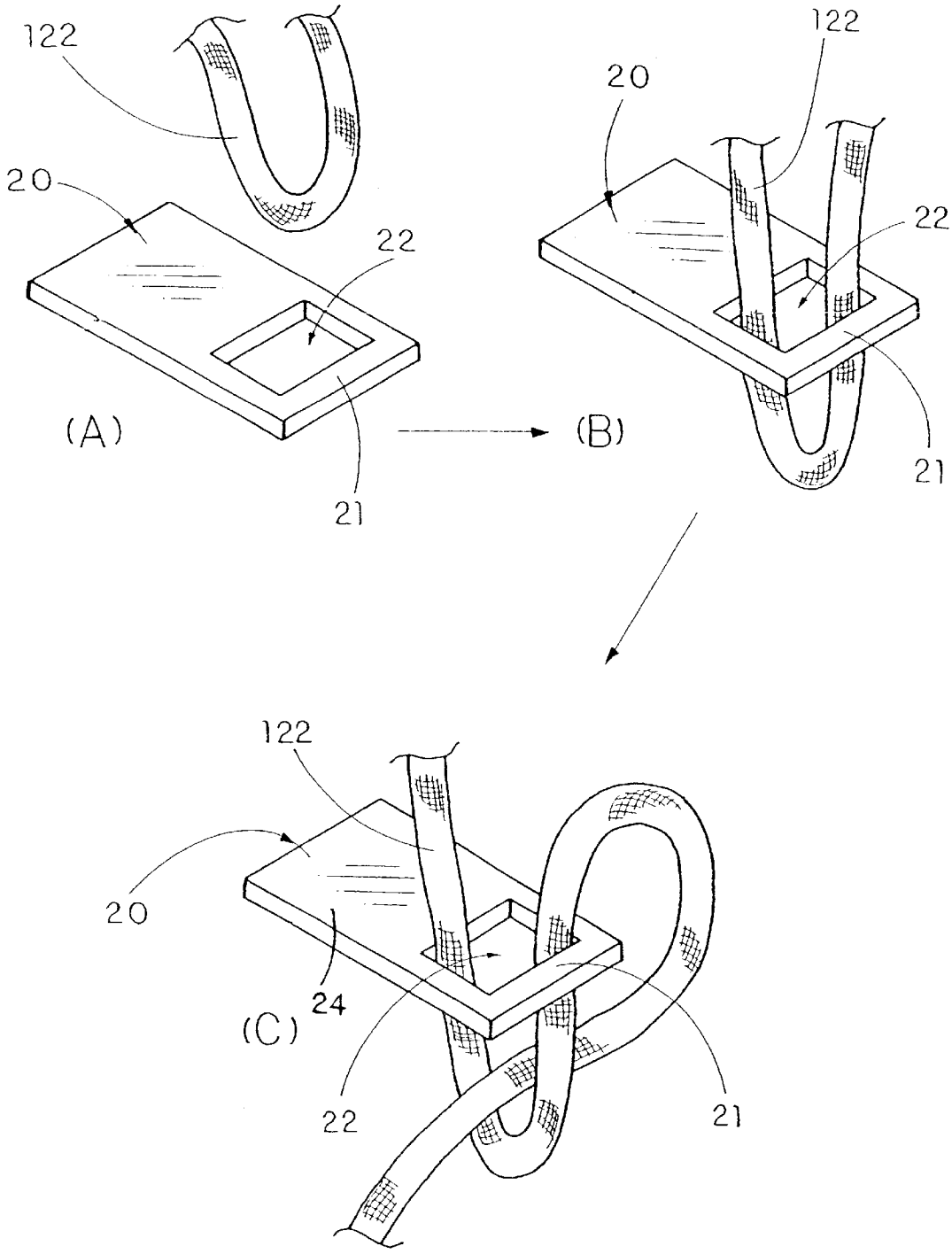
FIGS. 6A to 6C illustrate a method of tighten the adjustable knot on the cord stopper according to the above preferred embodiment of the present invention.

As shown in FIG. 5, when a sudden downward force is applied on the cord stopper 20, such as the slats 11 suddenly slide down from top, the adjustable knot 23 is automatically tied up on the locking guider 21 tightly, so as to lock up the downward unfolding movement of the slats 11. It is because when the sudden downward force is applied on the cord stopper 20, the sudden downward force will also be applied on the adjustable knot 23 to firmly tie up the adjustable knot 23 on the locking guider 21, so as to securely lock up the slats 11 in position.

Figure 7A:
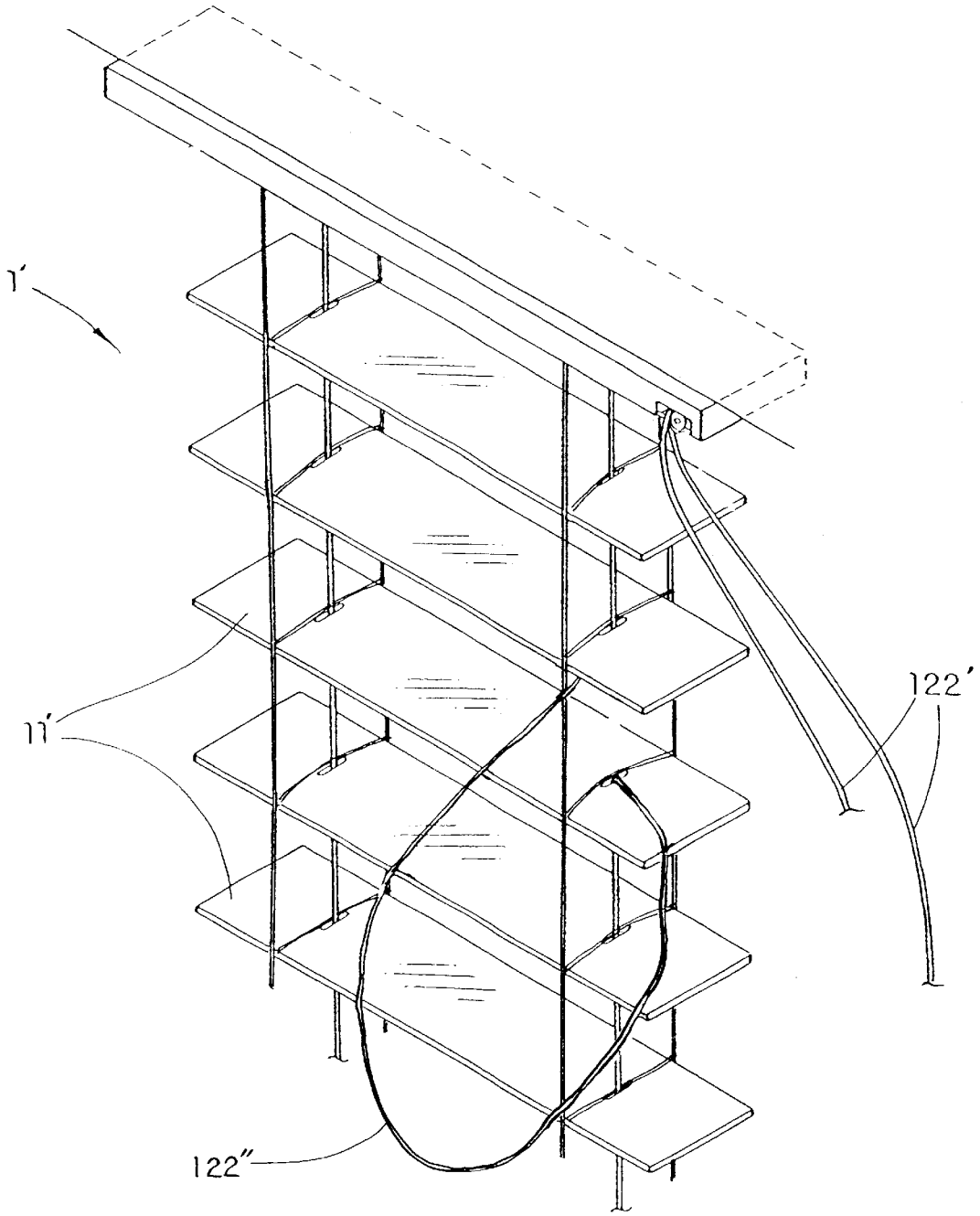
PRIOR ART FIG. 7A
FIG. 7A is a perspective view of a conventional window blind assembly without cord stopper incorporated, illustrating the cord is capable of pulling out between two slats of the window blind assembly.

In order to illustrate how the cord stoppers 20 of the present invention solve the conventional problems, a conventional window blind assembly 1' without any cord stopper incorporated is shown in FIG. 7A, wherein a child may easy pull the lift cord 122' between two slats 11' to form a lift cord loop 122" that may easily entangle around the child's neck and cause serious injury.

Figure 7B:
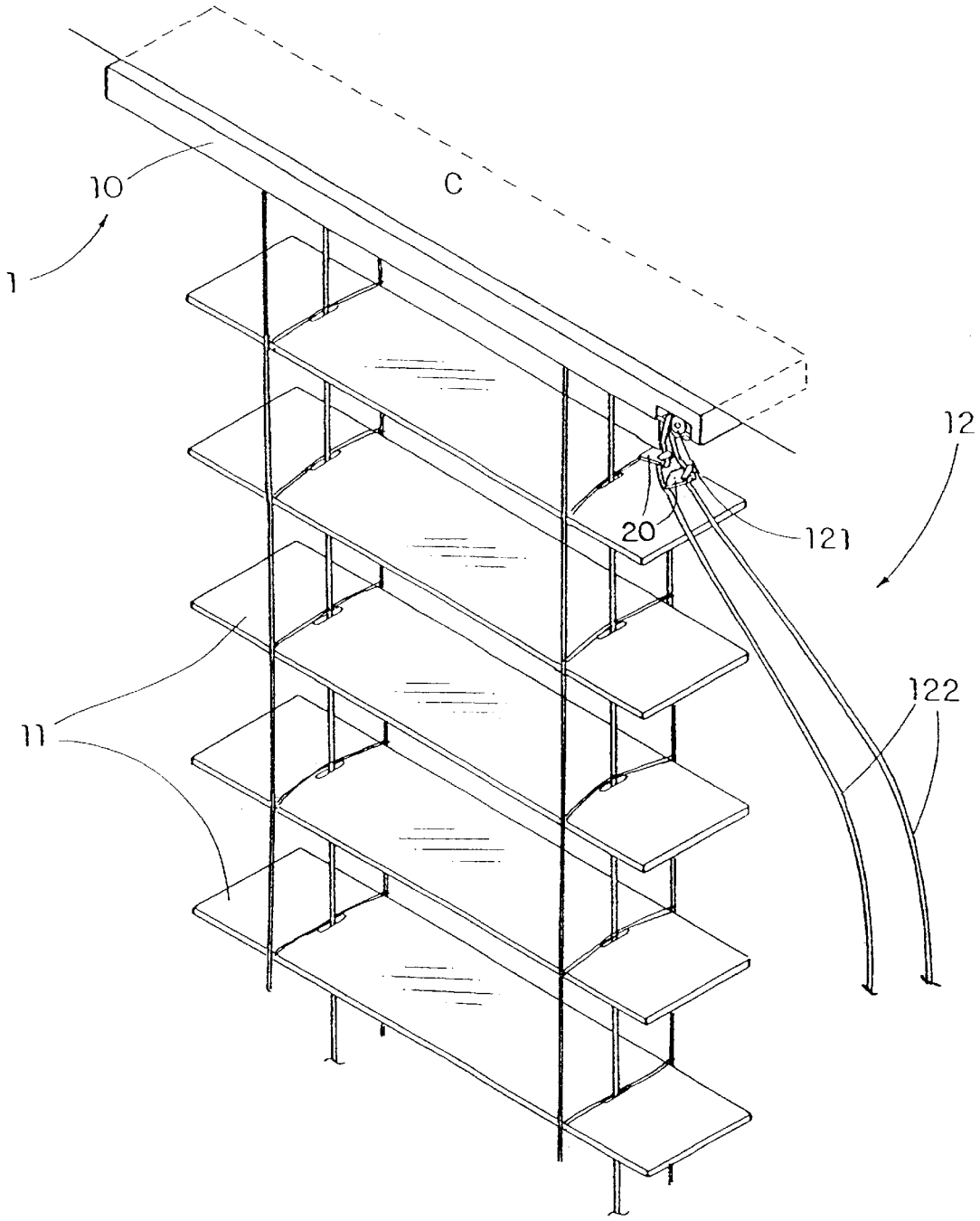
FIG. 7B is a perspective view illustrates how the adjustable cord stoppers limit the length of the lift cords of the window blind assembly according to the above preferred embodiment of the present invention.

However, according to the present invention, as shown in FIG. 7B, when the slats 11 of the window blind assembly 1 are unfolded, the user may simply slide the two cord stoppers 20 along the two lift cords 122 up towards the lift lock 121 so as to lock up the length of the lift cords 122 so that the lift cords 122 are unable to be pulled out between any two slats 11 so as to ensure the safety to the child.

Figure 7C:
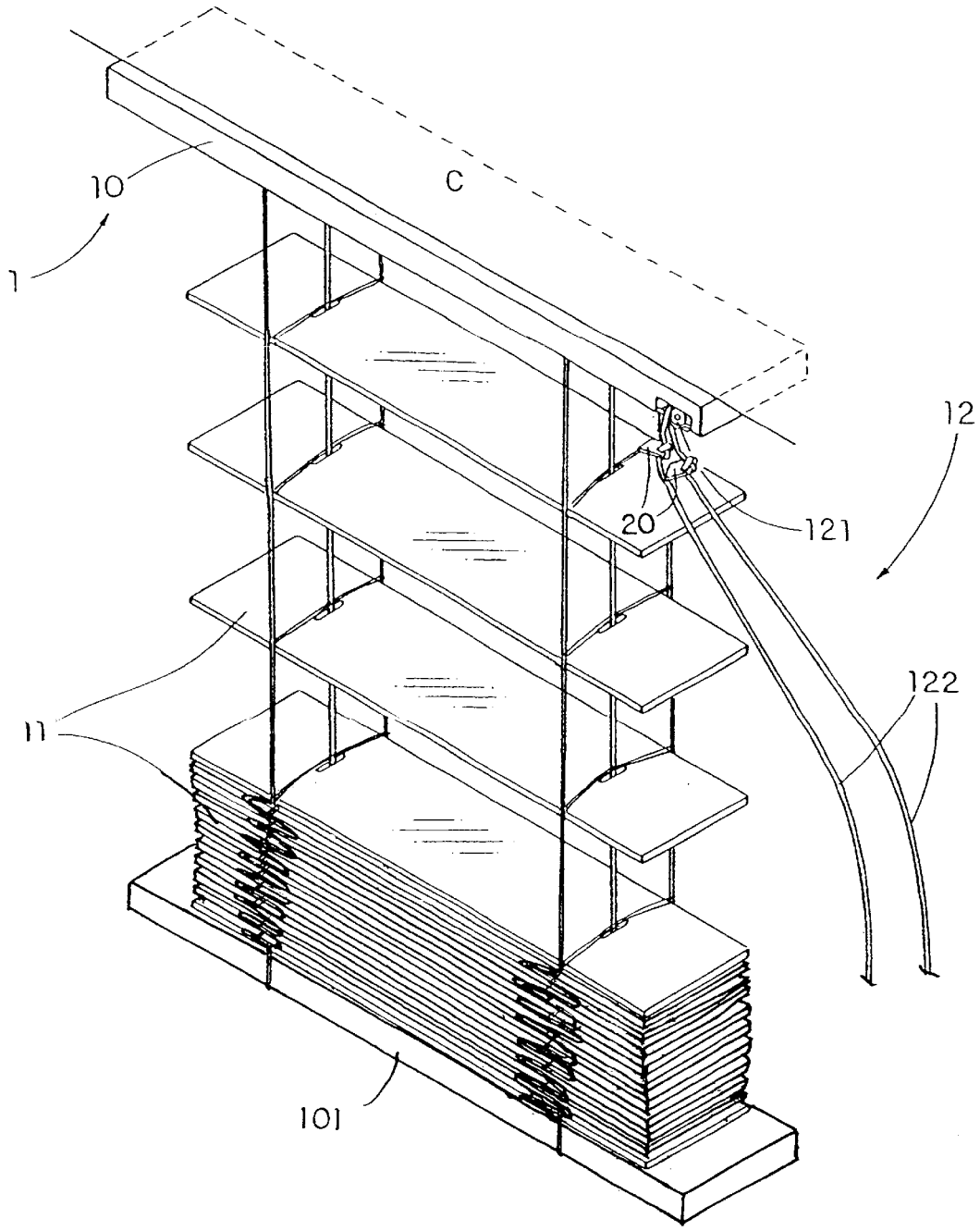
FIG. 7C is a perspective view illustrates how the adjustable cord stoppers lock up the folding condition of the window blind assembly according to the above preferred embodiment of the present invention.

Moreover, as shown in FIG. 7C, when the slats 11 of the window blind assembly 1 are gathered to a desired height by lifting up the bottom bar 101 by pulling both the two second end portions of the lift cords 122 downwards, the user can simply slide the two cord stoppers 20 along the two lift cords 122 up towards the lift lock 121 of the traverse supporter 10, so as to lock up such folding position of the window blind assembly 1 and thus prevent the bottom bar 101 and the slats 11 from dropping down accidentally in order to ensure the safety of the children. Preferably, the distance between the traverse supporter 10 and the cord stopper 20 is approximately from half inch to 2 inches.

For convenience, the cord stopper 20 further comprises a handle 24 extended rearwardly such that the user can hold the handle 24 to move the locking guider 21 upwardly and downwardly along the lift cord 122.

For unlocking the cord stopper 20 to unfold the window blind assembly 1, the user may simply hold the second end portion of the lift cord and move the cord stopper 20 downwards until adjustable knot 23 passing through the guiding through slot 23 to position above the guiding through slot 22 of the locking guider 21 and loose the adjustable knot 23 as well. Then the user is able to slide down the cord stopper 20 along the lift cord 122 easily and smoothly, so as to enable the window blind assembly 1 to be unfolded.

Figure 8D:
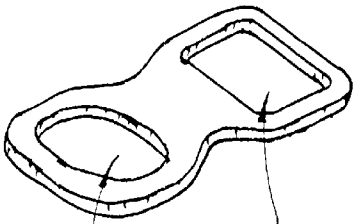
FIGS. 8A to 8D illustrate four alternative modes of the adjustable cord stopper according to the above preferred embodiment of the present invention.
Figure 8C:
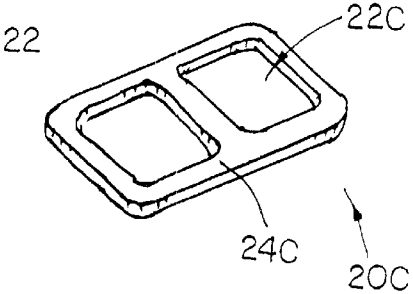
Figure 8A:
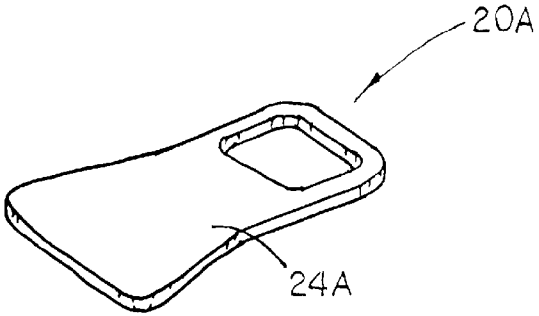
Figure 8B:
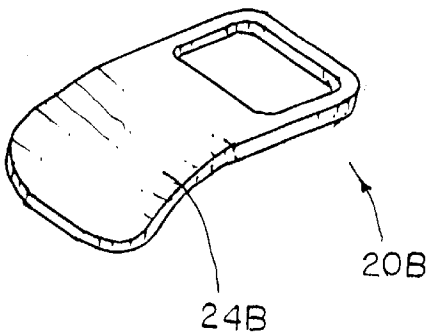

Referring to FIGS. 8A to 8D, four alternative modes of the adjustable cord stopper 20 are illustrated, wherein the cord stopper 20 can be modified to any shape. The area of the handle 24A of the cord stopper 20A is enlarged, which is facilitated for the user to move the cord stopper 20A along the lift cord 122 as shown in FIG. 8A. Likewise, as shown in FIG. 8B, the handle 24B has an enlarged curving surface adapted for easily manipulating the movement of the cord stopper 20B. Also, an additional guiding through slot 221C can be formed on the handle 24C so that there are two guiding through slots 22C, 221C provided on the cord stopper 20C so that the user may tie the adjustable knot 23 at either the guiding through slot 22C or the additional guiding through slot 221 C, as shown in FIG. 8C. Moreover, as shown in FIG. 8D, the cord stopper 20D can be shaped as a "8" shape having two guiding through slots 22D, 221D formed thereon in order to provide an aesthetic appearance of the window blind assembly 1.

Figure 9B:
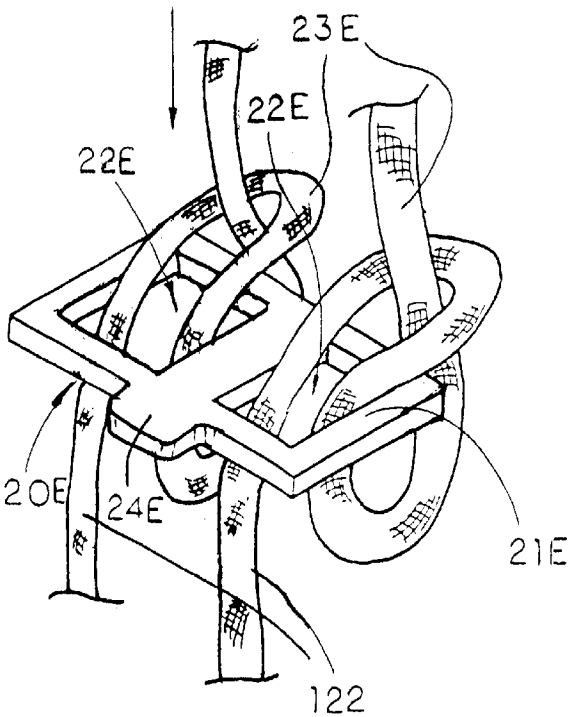
FIGS. 9A and 9B illustrate a fifth alternative mode of the adjustable cord stopper according to the above preferred embodiment of the present invention.
Figure 9A:
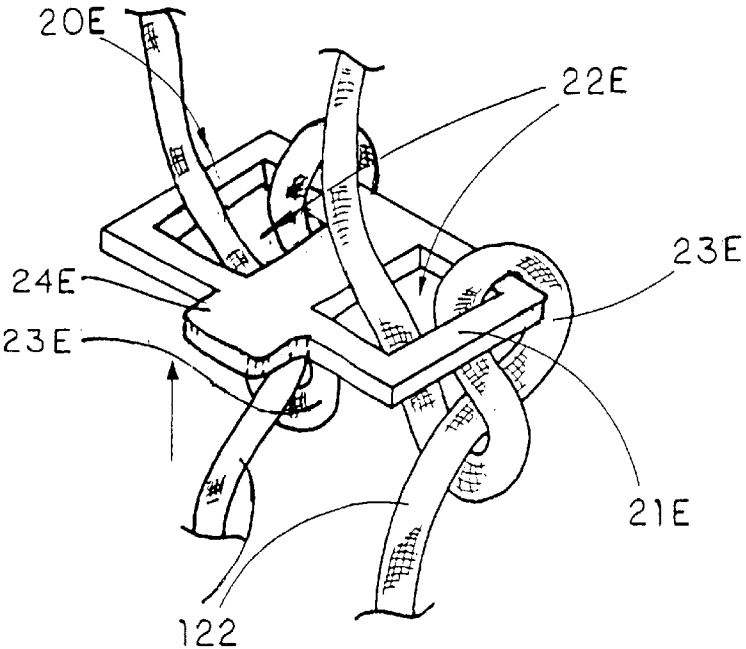

Referring to FIGS. 9A and 9B, a fifth alternative mode of the preferred embodiment of the present invention is illustrated, wherein two guiding through slots 22E provided on a locking guider 21E of a cord stopper 20E. When there are two guiding through slots 22E provided on the locking guider 21E, including the third alternative mode as shown in FIG. 8C, the two lift cords 12 can be tied to the two guiding through slots 22E respectively to form two adjustable knots 23E. Moreover, a handle 24E is protruded from one side of the locking guider 21E of the cord stopper 20E for facilitating the user to hold thereon. Therefore, the user may lock up or unlock both the lift cords 122 at the same time simply by sliding one cord stopper 20E up and down along the lift cords 122 at the same time. As shown in FIG. 9A, the two adjustable knots 23E are positioned below the two guiding through slots 22E of the cord stopper 20E, so that the cord stopper 20E can be slid up along the two lift cords 122. As shown in FIG. 9B, the two adjustable knots 23E are positioned above the two guiding through slots 22E of the cord stopper 20E, so that the cord stopper 20E can be slid down along the two lift cords 122.

What is claimed is:

1. A blind assembly equipped with a pair of adjustable cord stoppers, wherein said blind assembly comprises a top traverse supporter, a bottom bar, a plurality of slats, a blind supporting system for suspendedly and spacedly supporting said plurality of slats horizontally between said top traverse supporter and said bottom bar, and a lifting operation system for selectively lifting up said bottom bar towards said top traverse supporter and unlifting said bottom bar to drop downwardly away from said top traverse supporter, wherein said lifting operation system comprises a lift lock rotatably mounted on said top traverse supporter and a pair of lift cords each having a first end portion affixed to said bottom bar, wherein said two lift cords upwardly extend and penetrate through said slats parallelly and then traversely extend through said top traverse supporter while a second end portion of each of said lift cords is extended out of said top traverse supporter via said lift lock to control said raising and lowering of said window blind assembly, wherein each of said cord stoppers comprises a locking guider having at least a guiding through slot provided thereon, wherein each of said two locking guiders is slidably connected to said respective lift cord of said window blind assembly by tying an adjustable knot, at said guiding through slot, with said locking guider of said cord stopper, wherein each of said adjustable knots, with respect to said respective locking guider, is normally in a loosened manner that said cord stopper is able to slide along said respective lift cord, wherein when said adjustable knot is moved in an upper position above said guiding through slot and on one side of said respective cord stopper, said cord stopper is capable of sliding downwardly along said respective lift cord, wherein when said adjustable knot is moved in a lower position below said guiding through slot and on another side of said respective cord stopper, said cord stopper is capable of sliding upwardly along said respective lift cord.

2. A blind assembly equipped with a pair of adjustable cord stoppers, wherein said blind assembly comprises a top traverse supporter, a bottom bar, a plurality of slats, a blind supporting system for suspendedly and spacedly supporting said plurality of slats horizontally between said top traverse supporter and said bottom bar, and a lifting operation system for selectively lifting up said bottom bar towards said top traverse supporter and unlifting said bottom bar to drop downwardly away from said top traverse supporter, wherein said lifting operation system comprises a lift lock rotatably mounted on said top traverse supporter and a pair of lift cords each having a first end portion affixed to said bottom bar, wherein said two lift cords upwardly extend and penetrate through said slats parallelly and then traversely extend through said top traverse supporter while a second end portion of each of said lift cords is extended out of said top traverse supporter via said lift lock to control said raising and lowering of said window blind assembly, wherein each of said cord stoppers comprises a locking guider having at least a guiding through slot provided thereon, wherein a loop is formed on each of said lift cords to pass through said respective guiding through slot of said respective cord stopper, and then said second end portion of said respective lift cord is penetrated into said loop of said lift cord to form an adjustable knot slidably tying around said locking guider and having a size enabling said adjustable knot to be moved through said guide through slot from one side of said locking guider to another side of said locking guider.

3. The blind assembly, as recited in claim 2, wherein each of said guiding through slots has a size slightly larger than a size of said respective adjustable knot so as to enable each of said adjustable knots to be capable of passing through said respective guiding through slot between an upper position and a lower position of said locking guider of said cord stopper.

4. The blind assembly, as recited in claim 2, wherein said locking guiders are capable of being locked between a locked position and an unlocked position, wherein at said locked position, each of said locking guiders is locked by said respective adjustable knot at an upper position of said respective lift cord to lock up any downward movement of said slats and to prevent said bottom bar from dropping down, wherein at said unlocked position, each of said locking guiders is locked by said respective adjustable knot at a lower position of said respective lift cord to enable said slats to move downwardly.

5. The blind assembly, as recited in claim 3, wherein said locking guiders are capable of being locked between a locked position and an unlocked position, wherein at said locked position, each of said locking guiders is locked by said respective adjustable knot at an upper position of said respective lift cord to lock up any downward movement of said slats and to prevent said bottom bar from dropping down, wherein at said unlocked position, each of said locking guiders is locked by said respective adjustable knot at a lower position of said respective lift cord to enable said slats to move downwardly.

* * * * *